US006845583B2

(12) United States Patent
Lee

(10) Patent No.: US 6,845,583 B2
(45) Date of Patent: Jan. 25, 2005

(54) AUDIO/VISUAL GREETING DEVICE

(75) Inventor: Chih Jung Lee, Monterey Park, CA (US)

(73) Assignee: LUX Imports, Inc., Monterey Park, CA (US)

( * ) Notice: Subject to any disclaimer, the term of this patent is extended or adjusted under 35 U.S.C. 154(b) by 55 days.

(21) Appl. No.: 10/446,442

(22) Filed: May 28, 2003

(65) Prior Publication Data

US 2004/0237359 A1 Dec. 2, 2004

(51) Int. Cl.[7] ..... A47G 1/06

(52) U.S. Cl. ..... 40/717; 40/124.03; 40/124.06; 40/455

(58) Field of Search ..... 40/124.03, 124.06, 40/124.191, 455, 717; 360/1, 2; 379/75, 76

(56) References Cited

U.S. PATENT DOCUMENTS 3,691,312 A * 9/1972 Petersen ..... 40/455
3,857,191 A * 12/1974 Sadorus ..... 40/455
4,541,188 A * 9/1985 Sadorus ..... 40/717
5,063,698 A * 11/1991 Johnson et al. ..... 40/124.03
5,359,374 A * 10/1994 Schwartz ..... 40/455
5,499,465 A * 3/1996 Manico ..... 40/717
6,185,851 B1 * 2/2001 Loudermilk et al. ..... 40/717
6,282,819 B1 * 9/2001 Gu ..... 40/124.03
6,393,401 B1 * 5/2002 Loudermilk et al. ..... 40/717

* cited by examiner

*Primary Examiner*—Lars A. Olson
(74) *Attorney, Agent, or Firm*—Raymond Y. Chan; David and Raymond Patent Group

(57) ABSTRACT

A greeting device is adapted for presenting audio message and visual images. The record switch is pressed to activate the audio memory member. The user may direct his voice toward the microphone in order to record audio message into the audio memory member. A play switch is pressed for the user to listen to the audio message. A permanent recording function is activated to preserve the audio message without being erased and overwritten by future recordings. Finally, a photograph is inserted into a receiving pocket, so that the photograph together with the audio message constitutes audio/visual presentation of information.

21 Claims, 3 Drawing Sheets

AUDIO/VISUAL GREETING DEVICE

BACKGROUND OF THE PRESENT INVENTION

1. Field of Invention

This invention relates to a greeting card, and more particularly to an audio/visual greeting device that is capable of presenting greetings in a personalized way in form of audio message and visual images.

2. Description of Related Arts

A greeting card is sent to someone on holidays or special events in order to express the sender's feelings and emotions to the receiver. The card is usually printed with pictures and illustrations related to the holidays and the special events for helping emphasize the personal messages written in the card. The personal messages may be a brief note showing appreciations, congratulations and affections. After the sender writes down his words, the card may be sent to receiver by either hand delivery or postal service. Either way, it helps people to maintain their relationship.

The greeting cards have variations of form in order to provide special emphasis and effects. For example, a greeting card may further include a piece of specially designed cardboard folded and attached to the inner part of the greeting card in order to resemble certain characters and objects. When the card is opened, alone with the movement of the cover, the folded cardboard erects into three-dimensional characters and objects thereby making the reading of the card more interesting.

However, it is always desirable to make the greeting card more personal for effective communication. Conventionally, one way to achieve the end is to print a personal photograph on the cover of the card. A personal computer equipped with a high-resolution printer may be used to create such personalized card. An image processing software may be sued to edit the personal photograph in order to generate a desirable layout. A laser color printer is recommended for greeting a greeting card with high quality of image.

Although the technology development enables people to create a personalized greeting card on their own, the number of people who are able to do the job is limited. Many people do not have access to personal computers and high quality printers. For those who have the access to the equipment, many of them do not feel comfortable or lack the skill to process digital images. In addition, among the people who have the access to computer equipment and the skill for image processing many simply do not have the time to do it. Furthermore, it seems boring that the greeting card is only printed with a personal photograph without voice messages told by people.

Therefore, what is needed is a greeting card that is easily to be personalized by presenting greetings in the form of visual image and/or audio message.

SUMMARY OF THE PRESENT INVENTION

The present invention discloses a greeting device that is capable of presenting greetings in audio and/or visual form in order to provide personalized greetings. The present invention also discloses a method of how to use the greeting device to create such personalized greetings.

In order to accomplish the above objectives, the present invention provides a greeting device including:

a see-through front panel;

a base comprising a base panel, a bottom panel and a supporting layer attached between the front and bottom panels, wherein a receiving pocket is defined between the front panel and the base panel and the receiving pocket for receiving a visual article therein; and an audio device comprising a control circuit board, one or more batteries detachably mounted on the control circuit board, an audio memory member mounted on the circuit board and powered by the batteries, a record switch provided on the control circuit board, a play switch connected to the control circuit board, and a speaker connected to the control circuit board, wherein an audio message is able to be recorded in the audio memory member when the record switch is activated, and the recorded audio message is capable of playing through the speaker when the play switch is activated.

The present invention also provides a method for presenting audio message and visual images via the greeting device. The record switch is pressed to activate the audio memory member. The user may direct his voice toward the microphone in order to record audio message into the audio memory member. A play switch is pressed for the user to listen to the audio message. A permanent recording function is activated to preserve the audio message without being erased and overwritten by future recordings. Finally, a photograph is inserted into a receiving pocket, so that the photograph together with the audio message constitutes audio/visual presentation of information.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

A greeting device that is capable of presenting information in audio and/or visual form is disclosed. Drawings of perspective view will be used to explain how the mechanical and electrical structures of the greeting card enable such audio and visual presentation.

Figure 1:
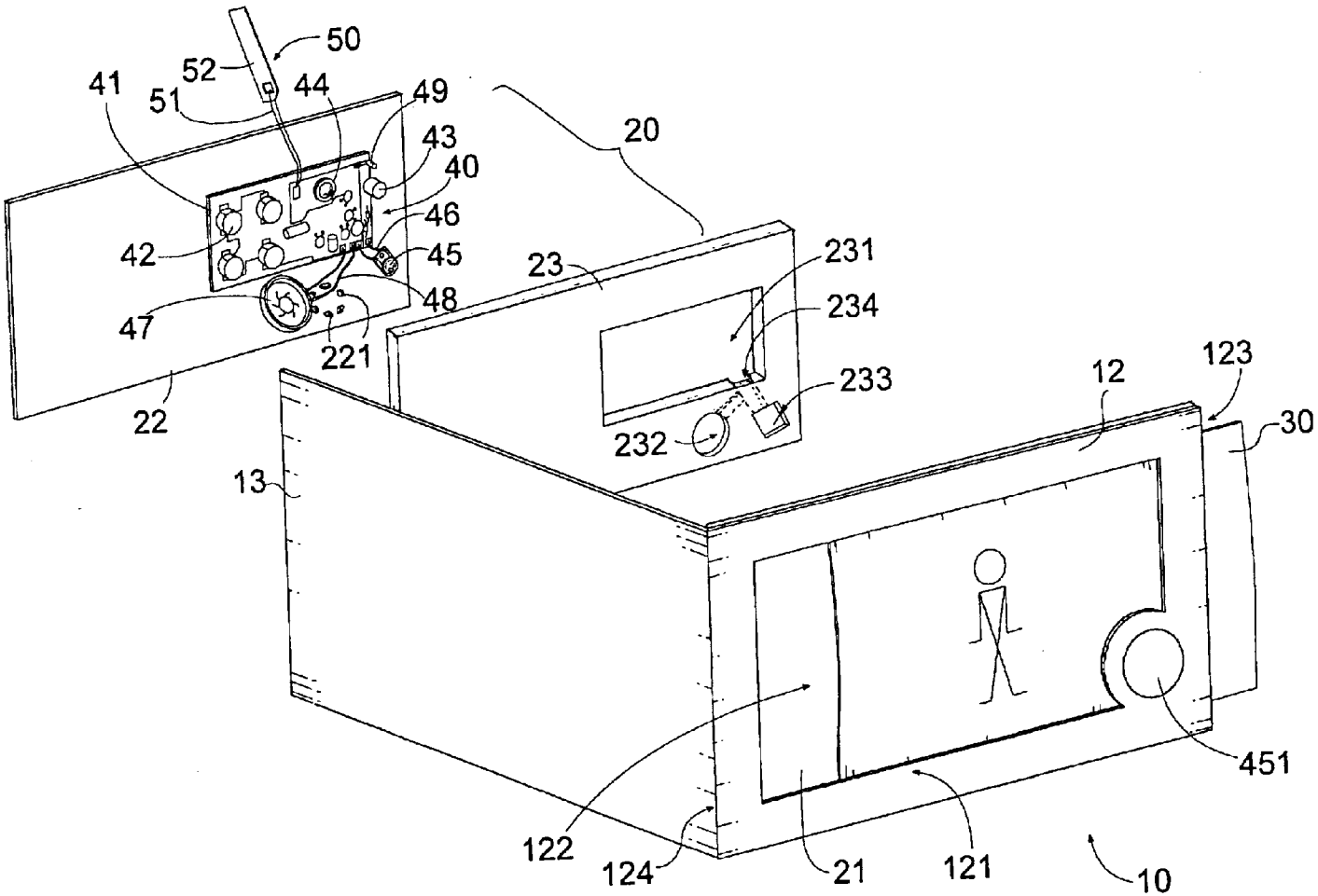
FIG. 1 is a perspective view illustrating a greeting device with a photograph framed thereon according to a preferred embodiment of the present invention.
Figure 2:
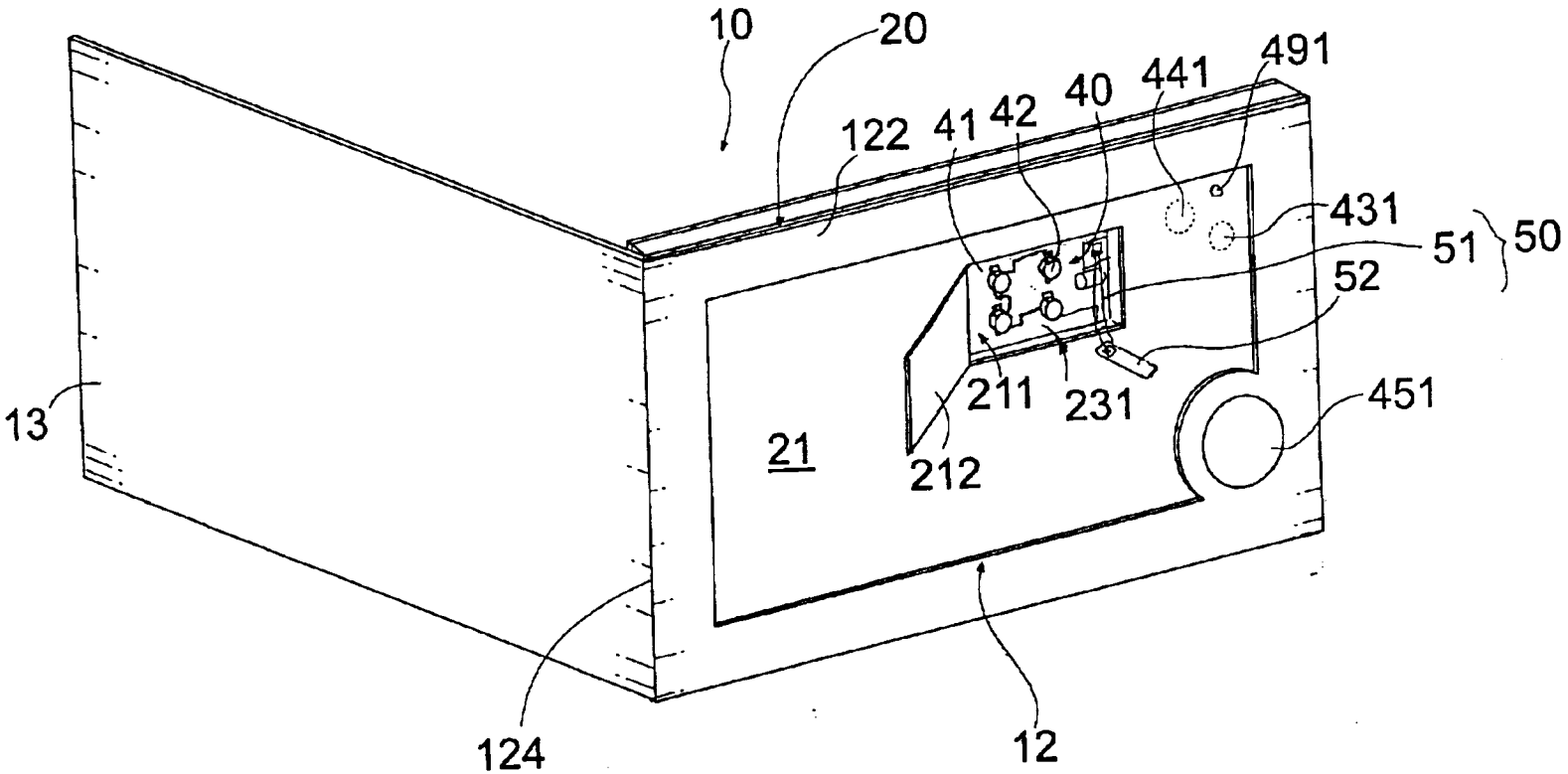
FIG. 2 is a perspective view illustrating the greeting device without photograph framed thereon according to the above preferred embodiment of the present invention.

Referring to FIG. 1 and FIG. 2, a greeting device 10 is illustrated according to a preferred embodiment of the invention. The greeting device 10 comprises a front panel 12 which is embodied as a frame having a display window 121 thereon and a base 20 comprising a base panel 21, a bottom panel 22 and a supporting layer 23 attached between the front and bottom panels 21, 22.

According to the preferred embodiment of the present invention, the base panel 21 can be connected with the front panel 12 edge to edge to define a receiving pocket 122 therebetween and an opening 123 at one side to enable a visual article 30 such as a photograph or a piece of note of personal significance to be inserted and received in the receiving pocket 122 therethrough, so that people can view the content of the visual article 30 through the display window 121. The visual article 30 serves as a visual presentation of greetings that helps the sender and the receiver better communicate their emotions, affections and appreciations.

The base 20 is made slightly bigger than the visual article 30 and that the front panel 12 overlaps the edge areas of the visual article 30 in order to nicely place the visual article 30 within the receiving pocket 122. It is however noted that the way to place a photograph between the front panel 12 and the base panel 21 of the base 20 is not limited to the embodying illustration as disclosed in the preferred embodiment. For example, the viewing window 121 of the front panel 12 may be made about the same size of the visual article 30 so that the visual article 30 can be directly fitted into the front panel 12 through its window. It is an apparent alternative that, instead of making the front panel 12 in a frame structure as shown in FIGS. 1 and 2, the front panel 12 can be made of transparent material so that the receiving pocket 122 is defined between the transparent front panel and the base panel 21 of the base 20 to receiving the visual article 30 while still being observed through the transparent front panel.

A cover 13 is extended from the front panel 12 and constructed to be folded on top of the front panel 12 to better protect the visual article 30. The cover 13 and the front panel 12 may be made out of the same piece of material, such as cardboard, paper, plastic and celluloid, with a folding line 124 dividing them apart. On the exterior side of the cover 13, pictures and illustrations are printed in order to generate visual effects to entertain receivers of the greeting device 10. As an alternative, the cover 13 may also be a piece of material physically separate from the front panel 12 that is capable of moving toward and leaving from the base 20.

Referring to FIG. 2, the greeting device 10 is shown without having any visual article 30 placing on top of the base 20. A U-shaped cut is provided in the front panel 21 to form an opening 211 and an opening cover 212 adapted to cover the opening 211. On the bottom panel 22, a set of speaker openings 221 is formed. On the supporting layer 23, an operation window 231, a speaker window 232, a switch cavity 233, and a wire channel 233 extending from the operation window 231 to the speaker window 232 and the switch cavity 233 are formed.

The greeting device 10 further comprises an audio device 40 which comprises a control circuit board 41, one or more batteries 42 detachably mounted on the control circuit board 41, an audio memory member 43 mounted on the circuit board and powered by the batteries 42, a record switch 44 provided on the control circuit board 41, a play switch 45 connected to the control circuit board 41 through a first pair of electric wires 46, a speaker 47 connected to the control circuit board 41 through a second pair of electric wires 48, and a LED 49 for operating indication.

The circuit board 41 is affixed on the bottom panel 22 at a position that the batteries 42 are just positioned at the operation window 231. Since the opening 211 is positioned right above the operation window 231, as shown in FIG. 2, so that the user may replace the batteries 42 via the opening 211 and the operation window 231. The speaker window 232 is positioned right above the speaker openings 221. The speaker 47 is mounted in the speaker window and positioned right on the speaker openings 221 so that recorded voice from the speaker 47 can be heard through the speaker openings 221. The play switch 45 is affixed on the bottom panel 22 and received in the switch cavity 233 of the supporting layer 23. The electric wires 46 and 48 are running through the wire channel 234 of the supporting layer 23. Accordingly, one would find that the supporting layer 23, which is preferably made of elastic material such as EVA, foaming material or rubber, not only provides a support between the base panel 21 and the bottom panel 22, but also substantially protects the audio device 40 from shock and damage.

Referring to FIGS. 1 and 2, a microphone mark 431, a record mark 441 and a lighting window 491 are provided on the base panel 21 at the positions with respect to the audio memory member 43, the record switch 44 and the LED 49 respectively, so that when the user presses on the record mark 441, the record switch 44 is precisely pressed by the user to activate the audio memory member 43 to receive and record audio message. The microphone mark 431 indicates where the mouth of the user should place around so as to ensure the audio message is perfectly recorded by the audio memory member 43. The audio message could be personalized greetings that are usually more vivid than written words. The LED 49 flashes on simultaneously upon the press of the record switch 44 to signal that the audio recording is in process. When the record switch 44 is released, the LED 49 goes off and the audio message is saved in the audio memory member 43 until the record switch 44 is pressed again and the audio recording process is reactivated.

Usually, the audio memory member 43 can save only a predetermined period of time such as a few seconds of audio information, so that if the record switch 44 is pressed for a period longer than the time limit of the audio memory member 43, the control circuit board 41 will issue a beep sound to warn that the space of the audio memory member is full.

A play mark 451 is provided on the front panel 12 and positioned right above the play switch 45, so that when the user presses the play mark 451, the play switch 45 will be precisely press to activate the audio memory member 43 to play the audio message recorded.

The play switch 45 is electrically connected to the speaker 47 and the control circuit board 41. When the play switch 45 is pressed, it sends out a command to the control circuit board 41 to audibly output the audio message recorded in the audio memory member 43 through the speaker 47. It is noted that the speaker 47 can be placed at any possible positions of the greeting device 10. The process of recording and playing audio message can be repeated and when every time the record switch 44 is pressed, the old audio message recorded in the audio memory member 43 will be overwritten by the new audio message. As a result, the recoding can be repeated until satisfaction.

In order to enable the greeting device 10 to permanently save the audio message in the audio memory member 43, a locking switch 50 is electrically connected to the control circuit board 41 for permanently saving the audio message in the audio memory member 43 without being erased or overwritten by new message. In the preferred embodiment, the locking switch 50 comprises a jump wire 51 electrically connected to the record switch 44 and the control memory member 43 and a flap 52 attached to the jump wire 51. By pulling the flap 52, the jump wire 51 is detached from the control circuit board 26 so as to disconnect the record switch 44 and the audio memory member 43. As such the audio message is permanently saved in the audio memory member 43 without being erased or overwritten.

The audio memory member 43 together with the visual article 30 placed between the front panel 12 and the base panel 21 of the base 20 constitutes personalized greetings. Any notes, illustrations, or a piece of paper that has personal significance can replace the photograph to function as visual article 30. The audio message can be made in association with the particular meaning of the photograph to create a special audio/visual presentation of information that enables the sender and the receiver better communicate their emotions, appreciations and affections. Thus, the greeting device 10 effectively helps people maintain their relationship.

Figure 3:
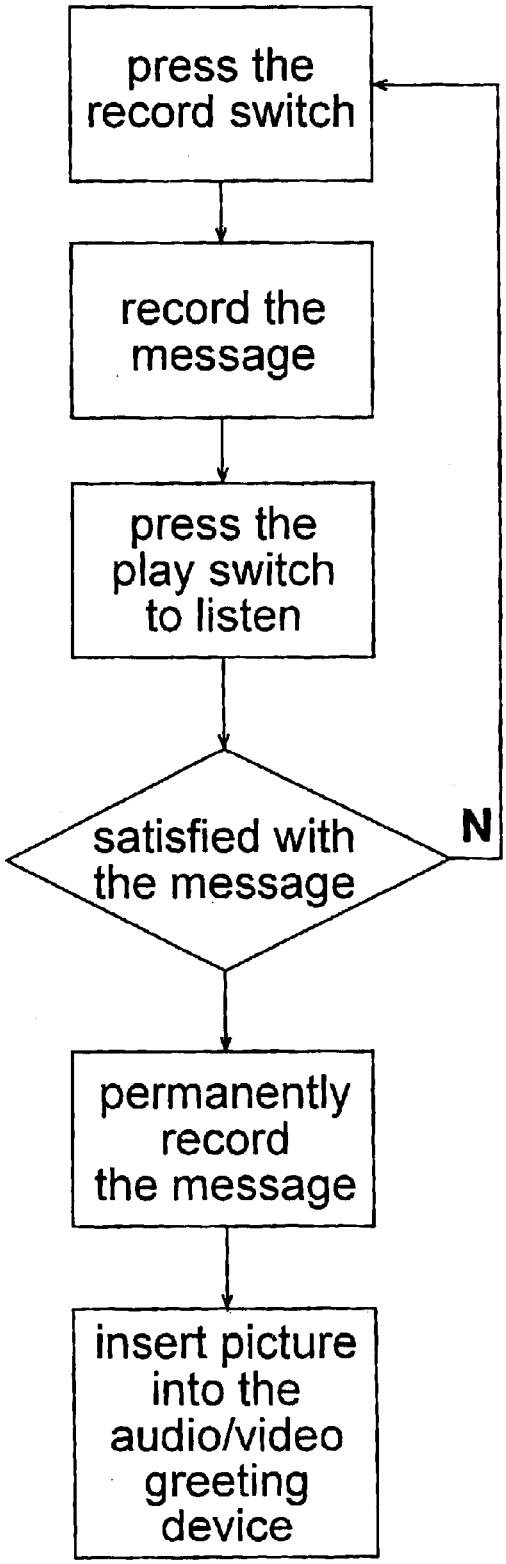
FIG. 3 is a flow chart illustrating an operation process of the greeting device to create an audio/visual presentation of information.

Referring to FIG. 3, an operation process for the audio/visual greeting device in a personalized way is shown, which comprises the following steps:

(a) To record personalized greetings, the user presses and holds the record switch 44 to activate the recording function of the audio memory member 43.

(b) The user then directs his voice to the microphone of the audio memory member so as to save his audio message in the audio memory member 43. It is noted that the audio message recorded in the audio memory member 43 does not have to be human voices; they could be any kind of sound and music according to the user's choices.

(c) After finishing the recording, the user releases the record switch 44 and presses the play switch 45 to listen to the message saved in the audio memory member 43.

(d) If the user is not satisfied with the messages recorded, he can redo the recording process from step 42 to step 46 until he is satisfied.

(e) If the user is satisfied with the messages recorded, the user may detach the locking switch 50 to permanently save the messages in the audio memory member 43 without having the message being erased or overwritten by new message.

(f) Finally, the use may insert visual article 30 such as a photograph, a note, or any visual showing of personal significance into the audio/visual greeting device 10.

As such, the user is able to create a personalized greeting card that presents his greetings in audio and visual forms to better communicate his emotions to the receiver.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A greeting device, comprising:

a see-through front panel;

a base comprising a base panel, a bottom panel and a supporting layer attached between said front and bottom panels, wherein a receiving pocket is defined between said front panel and said base panel and said receiving pocket for receiving a visual article therein; and an audio device comprising a control circuit board, one or more batteries detachably mounted on said control circuit board, an audio memory member mounted on to said circuit board and powered by said batteries, a record switch provided on said control circuit board, a play switch connected to said control circuit board, and a speaker connected to said control circuit board, wherein an audio message is able to be recorded in said audio memory member when said record switch is activated, and said recorded audio message is capable of playing through said speaker when said play switch is activated.

2. The greeting device, as recited in claim 1, wherein said supporting layer has an operation window provided therein and said base panel has an opening provided thereon, wherein said circuit board is affixed on said bottom panel at a position that said batteries are just positioned at said operation window and said opening is positioned right above said operation window for batteries replacement.

3. The greeting device, as recited in claim 2, wherein said bottom panel has a plurality of speaker openings are provided and said supporting layer has a speaker window formed thereon and positioned right above said speaker openings, wherein said speaker is mounted in said speaker window and positioned right on said speaker openings.

4. The greeting device, as recited in claim 1, wherein said supporting layer has a switch cavity provided thereon and said play switch is affixed on said bottom panel and received in said switch cavity of said supporting layer.

5. The greeting device, as recited in claim 3, wherein said supporting layer has a switch cavity provided thereon and said play switch is affixed on said bottom panel and received in said switch cavity of said supporting layer.

6. The greeting device, as recited in claim 1, wherein said audio device further comprising a lighting element to provide lighting alert when a memory space of said audio memory member is full when said record switch is activated.

7. The greeting device, as recited in claim 5, wherein said audio device further comprising a lighting element to provide lighting alert when a memory space of said audio memory member is full when said record switch is activated.

8. The greeting device, as recited in claim 5, wherein a microphone mark and a record mark are provided on said base panel at positions with respect to said audio memory member and said record switch respectively in such a manner that when said record mark is pressed, said record switch is pressed to activate said audio memory member to receive and record audio message, wherein said microphone mark indicates where said audio message should say to so as to ensure said audio message is recorded by said audio memory member.

9. The greeting device, as recited in claim 7, wherein a microphone mark, a record mark and a lighting window are provided on said base panel at positions with respect to said audio memory member, said record switch and said lighting element respectively in such a manner that when said record mark is pressed, said record switch is pressed to activate said audio memory member to receive and record audio message, wherein said microphone mark indicates where said audio message should say to so as to ensure said audio message is recorded by said audio memory member, wherein when said record switch is released, said lighting element goes off and said audio message is saved in said audio memory member until said record switch is pressed again and said audio recording process is reactivated.

10. The greeting device, as recited in claim 5, wherein a play mark is provided on said front panel and positioned right above said play switch, wherein when said play mark is pressed, said play switch is pressed to activate said audio memory member to play said audio message recorded.

11. The greeting device, as recited in claim 7, wherein a play mark is provided on said front panel and positioned right above said play switch, wherein when said play mark is pressed, said play switch is pressed to activate said audio memory member to play said audio message recorded.

12. The greeting device, as recited in claim 9, wherein a play mark is provided on said front panel and positioned right above said play switch, wherein when said play mark is pressed, said play switch is pressed to activate said audio memory member to play said audio message recorded.

13. The greeting device, as recited in claim 1, wherein said audio device further comprises a locking switch electrically connected to said control circuit board for permanently saving said audio message in said audio memory member without being erased or overwritten.

14. The greeting device, as recited in claim 13, wherein said locking switch comprises a jump wire electrically connected to said record switch and said control memory member and a flap attached to said jump wire, wherein by pulling said flap, said jump wire is detached from said control circuit board so as to disconnect said record switch and said audio memory member and thus said audio message is permanently saved in said audio memory member.

15. The greeting device, as recited in claim 12, wherein said audio device further comprises a locking switch electrically connected to said control circuit board for permanently saving said audio message in said audio memory member without being erased or overwritten, wherein said locking switch comprises a jump wire electrically connected to said record switch and said control memory member and a flap attached to said jump wire, wherein by pulling said flap, said jump wire is detached from said control circuit board so as to disconnect said record switch and said audio memory member and thus said audio message is permanently saved in said audio memory member.

16. The greeting device, as recited in claim 1, wherein said front panel is a frame having a display window thereon, said base panel is connected with said frame edge to edge to define said receiving pocket therebetween and said opening is provided at one side to enable said visual article to be received in said receiving pocket therethrough.

17. The greeting device, as recited in claim 15, wherein said front panel is a frame having a display window thereon, said base panel is connected with said frame edge to edge to define said receiving pocket therebetween and said opening is provided at one side to enable said visual article to be received in said receiving pocket therethrough.

18. The greeting device, as recited in claim 15, further comprising a cover extended from said front panel and constructed to be folded on top of said front panel; to better protect said visual article.

19. The greeting device, as recited in claim 17, further comprising a cover extended from said front panel and constructed to be folded on top of said front panel to better protect said visual article.

20. A method of presenting audio message and visual image through an audio/visual greeting card, comprising the steps of:

(a) pressing a record switch of said greeting card to activate a recording function of an audio memory member of an audio device of said greeting card;

(b) recording an audio message in said audio memory member;

(c) releasing pressing of said record switch and pressing a play switch of said greeting card to listen to said audio message saved in said audio memory member;

(d) redoing the steps (a) to (c) when not satisfied with said audio messages recorded; and (e) placing a visual article in a receiving pocket of said greeting card.

21. The method, as recited in claim 20, further comprising a step of activating a locking switch to permanently save said audio message recorded in said audio memory member without having said audio message being erased or overwritten by new message.

* * * * *